343-700 MS AU 254 EX
1/18/83 XR 4,369,447

United States Patent [19]

Edney

[11] 4,369,447

[45] Jan. 18, 1983

[54] ANNULAR SLOT ANTENNA

[75] Inventor: Kenneth J. Edney, Somerset, England

[73] Assignee: EMI Limited, Hayes, England

[21] Appl. No.: 168,397

[22] Filed: Jul. 10, 1980

[30] Foreign Application Priority Data

Jul. 12, 1979 [GB] United Kingdom ..... 7924249

[51] Int. Cl.[3] ..... H01Q 13/12

[52] U.S. Cl. ..... 343/769; 343/700 MS

[58] Field of Search ..... 343/700 MS, 769, 708, 343/705, 789

[56] References Cited

U.S. PATENT DOCUMENTS

| | | | |
|---|---|---|---|
| 2,539,680 | 1/1951 | Wehner | 343/789 |
| 2,947,987 | 8/1960 | Dodington | 343/769 |
| 3,239,838 | 3/1966 | Kelleher | 343/789 |
| 3,568,206 | 3/1971 | Sisson | 343/750 |
| 3,665,480 | 5/1972 | Fassett | 343/769 |
| 3,680,136 | 7/1972 | Collings | 343/854 |
| 3,713,167 | 1/1973 | David | 343/797 |
| 3,774,223 | 11/1973 | Ehrenspeck et al. | 343/779 |
| 4,229,744 | 10/1980 | Luedtke et al. | 343/769 |

FOREIGN PATENT DOCUMENTS

| | | |
|---|---|---|
| 847035 | 9/1960 | United Kingdom . |
| 1390514 | 9/1972 | United Kingdom . |

OTHER PUBLICATIONS

Cumming et al., "Design Data for Small Annular Slot Antennas" IRE Trans. on Antennas and Propagation, Apr. 1958, pp. 210–211.

Jasik, Henry, Antenna Engineering Handbook, McGraw-Hill, N.Y. 1961, pp. 8-8 thru 8-15, 27-31 thru 27-37.

*Primary Examiner*—David K. Moore
*Attorney, Agent, or Firm*—Fleit & Jacobson

[57] ABSTRACT

The antenna comprises an open-mouthed cylindrical cavity 1 defined by side 11 and bottom 12 walls. A conductive coating 5 on an insulative substrate 4 lies on the bottom wall 12. The coating 5 is spaced from the side wall 11 by an annular space 2. A coaxial line 7, 8 feeds microwave energy to the zone between the coating 5 and the wall 12. That zone acts as a radial transmission line which couples the coaxial line to the cavity.

6 Claims, 6 Drawing Figures

ANNULAR SLOT ANTENNA

The present invention relates to antennas.

It is desirable in many situations to provide a small antenna having a low profile so as not to substantially effect the shape of the body on which the antenna is mounted. Examples of such antennae are described in the book "Antenna Engineering Handbook" by Jasik, published by McGraw Hill, on pages 27–35 and 27–36 and on pages 8—8 to 8–15. The described antennae include annular slot antennae. An annular slot antenna may be visualised as the open end of a large diameter low characteristic impedance coaxial line. The essential feature of the described annular slot antennae is that the mouth of the annular slot is flush with the conducting ground plane.

It is known to place cavities behind antennas, e.g. a rectangular slot antenna backed by a cavity as shown in Jasik section 8–9. Pages 27–36 of Jasik illustrates a cavity-backed annular slot antenna. However, in this case, the cavity is essentially a lumped-element resonator, not a distributed element resonant structure. Here, again, the annular slot is essentially flush with a ground plane.

An object of the present invention is to provide an alternative antenna.

According to the present invention, there is provided an antenna, comprising an open-mouthed cylindrical cavity defined by electrically conductive side and bottom walls, a conductive plate spaced from and facing the mouth of the cavity and spaced from and electrically isolated from the walls of the cavity, and means for feeding electromagnetic energy of microwave frequency to, or receiving such energy from, the space between the plate and the bottom wall, thereby to feed the energy to, or receive the energy from, the cavity.

Figure 1A:
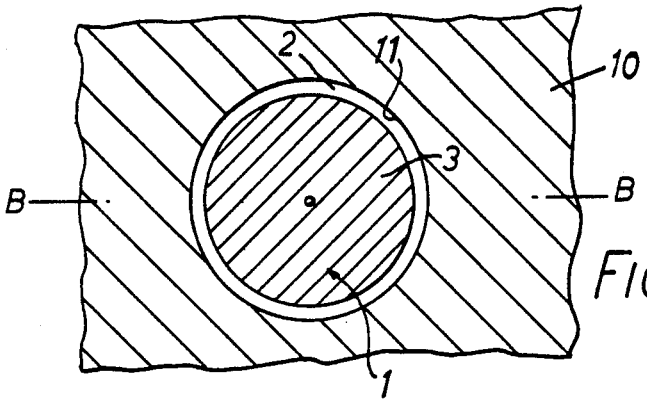
Figure 1B:
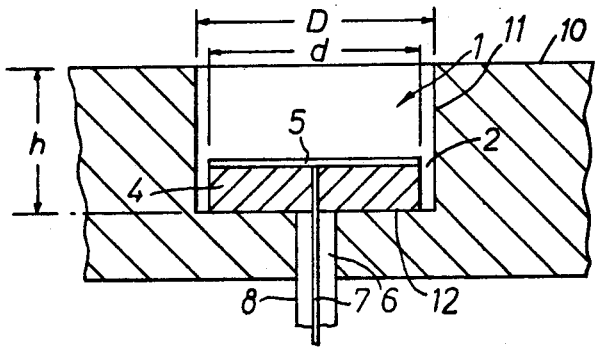
Figure 2A:
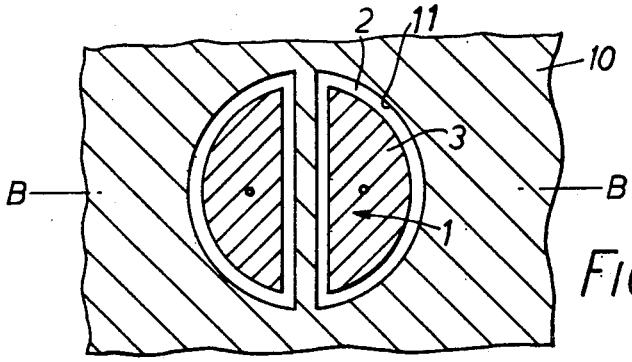
Figure 2B:
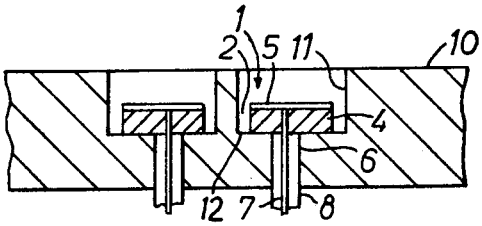
Figure 3A:
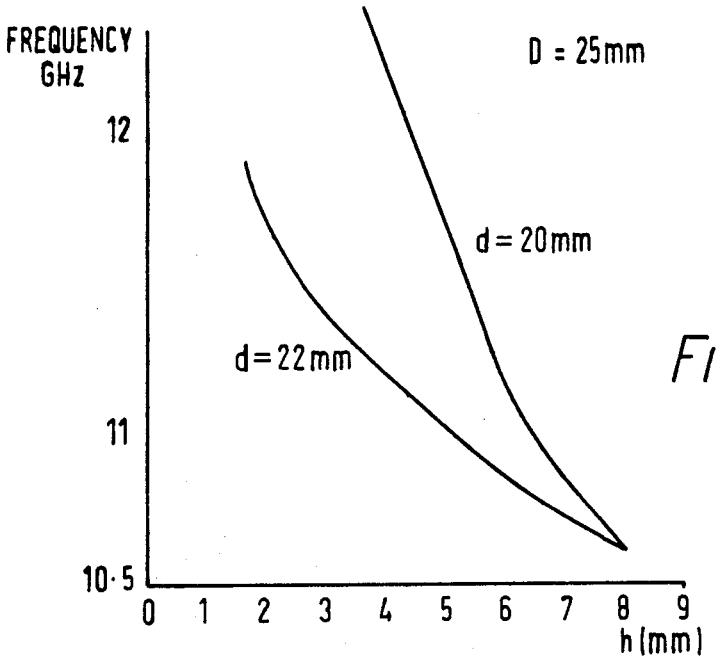
Figure 3B:
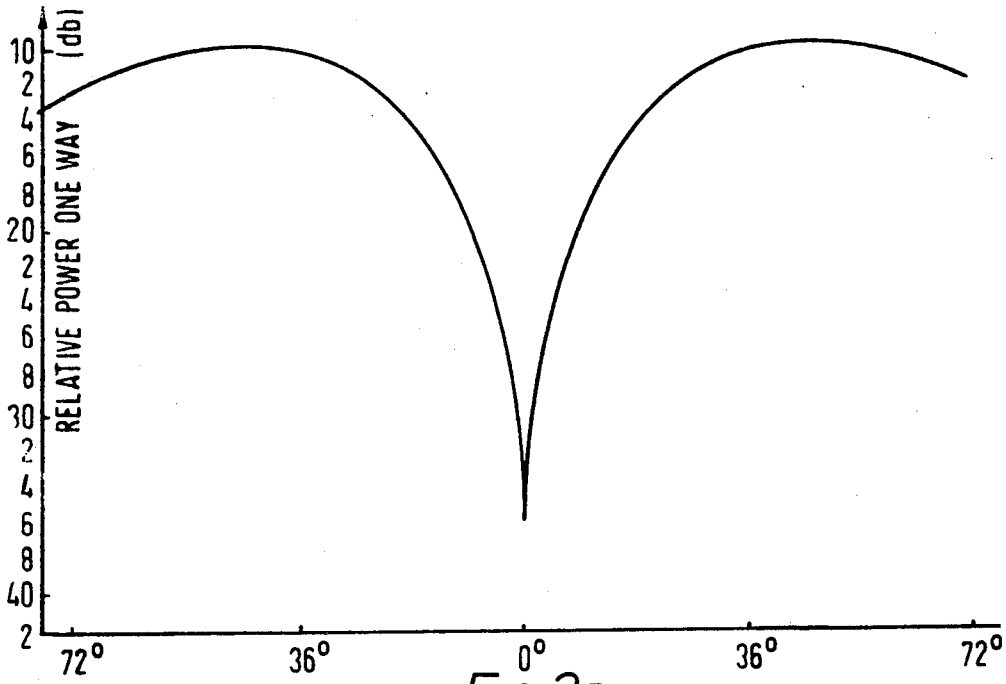

For a better understanding of the invention, and to show how the same may be carried into effect, reference will now be made by way of example to the accompanying drawings, in which FIGS. 1A and 2A are plan views of antennas according to the invention, FIGS. 1B and 2B are elevational sectional views on lines B—B of FIGS. 1A and 2A respectively, FIG. 3A shows variation in resonant frequency with various parameters of an antenna, and FIG. 3B shows a typical radiation pattern.

Referring to FIGS. 1A and 1B, a circular cavity 1 having an open mouth is defined within a member at least the side 11 and bottom 12 walls of the cavity being electrically conductive. The cavity is surrounded by a ground plane 10. A circular disc 3 is placed within the cavity, the disc being spaced from the side wall of the cavity as shown, whereby an annular region 2 is defined between the disc and the side wall of the cavity. The disc comprises an electrically insulative dielectric substrate 4 on which there is an electrically conductive coating 5. The substrate lies on the bottom wall or floor of the cavity and so the disc is spaced from the mouth of the cavity. A bore 6 is provided in the bottom wall of the cavity concentrically with the disc and the cavity. Through the bore extends a coaxial line portion, the inner conductor 7 of which is connected to the coating 5, and the outer conductor 8 of which is connected to the cavity walls. The coating 5 and substrate 4 provide a radial transmission line which feeds energy from the coaxial line 7, 8 to the cavity. The annular region 2 provides a transition region between the radial line and the cavity.

The cavity and disc need not be circular, but may be of any suitable shape. For instance a semicircular cavity and disc may be used. FIGS. 2A and B show two semicircular cavities side by side.

In FIG. 2 elements equivalent to elements in FIG. 1 have the same reference numerals as in FIG. 1. It is believed that a description of FIGS. 2A and 2B is therefore unnecessary.

The circular cavity gives an aerial response pattern having circular symmetry; other shapes would give different patterns.

The radiation beyond the ground plane 10 is primarily influenced by the dimensions of the cavity 1. The resonant frequency of the circular antenna is a function of cavity depth h, cavity diameter D, and disc diameter d as illustrated in FIG. 3A for examples of the antenna where D=25 mm and d=20 mm and 22 mm. It is thought that the resonant frequency decreases with increasing cavity diameter D. Cavity diameter D and disc diameter d initially determine a resonant frequency which can be moved to any other frequency within a wide range by appropriate choice of h.

The bandwidth of the antenna increases with increasing cavity depth h.

Compared to a conventional annular slot antenna, the invention provides an antenna which has a greater capability of providing a desired resonant frequency when matched to a coaxial line of predetermined impedance. However, the problem of designing the antenna is quite complex, involving the matching of the radial transmission line (the printed disc), the impedance of which varies with the diameter of the coaxial line portion into the cavity, the impedance of the cavity being dependent on cavity dimensions.

A typical radiation pattern is shown in FIG. 3B. This pattern is produced by mounting an antenna as shown in FIGS. 1A and B on a ground plane. The null performance is good and spurious sidelobes in this region are almost non-existent.

Although the cavity is shown in the figures surrounded by a ground plane 10, the ground plane is not essential. Thus the antenna may comprise a thin walled cavity somewhat like a horn antenna.

Although the invention has been described as a transmitter, it may also operate as a receiver, of radiation.

What I claim is:

1. An antenna comprising an open mouthed cylindrical cavity defined by an electrically conducting side wall of uniform diameter, and by an electrically conducting bottom wall, an electrically insulating support member lying on the bottom wall, an electrically conducting plate mounted to the support member in a position spaced from and facing the mouth of the cavity to define a space between the plate and bottom wall, and being electrically isolated from the wall to define a substantially annular slot between the plate and side wall, and means for feeding electromagnetic energy of microwave frequency to, or receiving such energy from, said space to thereby feed the energy to or receive energy from the cavity.

2. An antenna according to claim 1 wherein the electrically conducting plate comprises an electrically conducting coating applied to said electrically insulating support member.

3. An antenna according to claim 1 or 2, wherein the cavity is circular in cross-section.

4. An antenna according to claim 1 or 2, wherein the cavity is semi-circular in cross-section.

5. An antenna according to claim 1 or 2, wherein the feeding means comprises a coaxial line portion having a central conductor connected to the said plate and an outer conductor connected to the bottom wall.

6. An antenna according to claim 1 or 2 further comprising a ground plane surrounding the mouth of the cavity.

* * * * *